US010611005B2

(12) United States Patent
Oliver

(10) Patent No.: US 10,611,005 B2
(45) Date of Patent: Apr. 7, 2020

(54) POWER TOOL ACCESSORY FOR PREVENTING FASTENER FALLS DURING FASTENER REMOVAL OR INSTALLATION OPERATIONS

(71) Applicant: Northrop Grumman Systems Corporation, Falls Church, VA (US)

(72) Inventor: Steven S. Oliver, Tehachapi, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 201 days.

(21) Appl. No.: 15/855,016

(22) Filed: Dec. 27, 2017

(65) Prior Publication Data

US 2019/0193252 A1 Jun. 27, 2019

(51) Int. Cl.

| | |
|---|---|
| ***B25B 23/02*** | (2006.01) |
| ***B25F 5/02*** | (2006.01) |
| ***B25B 21/00*** | (2006.01) |
| ***B25B 23/00*** | (2006.01) |

(52) U.S. Cl.

CPC ..... *B25B 23/02* (2013.01); *B25B 21/007* (2013.01); *B25B 23/00* (2013.01); *B25F 5/02* (2013.01)

(58) Field of Classification Search

CPC ..... B25B 21/007; B25B 23/00; B25B 23/02; B25B 29/00; B25F 5/02; A45C 11/24; A45F 2200/0575; B23Q 11/0053; B23Q 11/0071

USPC ..... 81/53.11, 53.12, 180.1

See application file for complete search history.

(56) References Cited

U.S. PATENT DOCUMENTS

| | | | | |
|---|---|---|---|---|
| 3,583,821 | A * | 6/1971 | Shaub | B23Q 11/0053 408/72 R |
| 4,955,984 | A * | 9/1990 | Cuevas | B23Q 11/0053 408/67 |
| 6,671,931 | B1 * | 1/2004 | Duncan | B25F 5/006 16/430 |
| 7,175,371 | B2 * | 2/2007 | Vidal | B23Q 11/0064 408/1 R |
| D588,893 | S * | 3/2009 | Radich | D8/70 |
| 8,109,344 | B1 * | 2/2012 | Hays | B25F 3/00 173/171 |
| 9,597,736 | B2 * | 3/2017 | Steele | B23B 51/05 |
| 9,713,864 | B2 * | 7/2017 | Chiusolo | B23Q 11/0071 |
| 9,833,886 | B1 * | 12/2017 | Olson | B25B 23/02 |
| 9,833,893 | B2 * | 12/2017 | Moreau | A45F 5/00 |
| 2013/0034396 | A1 * | 2/2013 | Witthoeft | B23Q 11/0071 408/67 |
| 2014/0037392 | A1 * | 2/2014 | Lo | B23Q 11/0071 408/67 |
| 2017/0066095 | A1 * | 3/2017 | Chen | B23Q 11/0071 |

* cited by examiner

*Primary Examiner* — David B. Thomas
(74) *Attorney, Agent, or Firm* — Burr & Forman LLP

(57) ABSTRACT

An accessory for catching a fastener responsive to operation of a power tool having a working assembly for driving or removing the fastener may include a working end, a coupling end opposite the working end, and a catch portion disposed between the working end and the coupling end. The coupling end may be configured to be operably coupled to the power tool to be fixed rotationally and axially relative to an axis of the working assembly. The catch portion may extend substantially coaxial with the axis of the working assembly away from the coupling end to the working end. The working end may be configured to extend beyond a distal end of the working assembly.

17 Claims, 3 Drawing Sheets

FIG. 3.
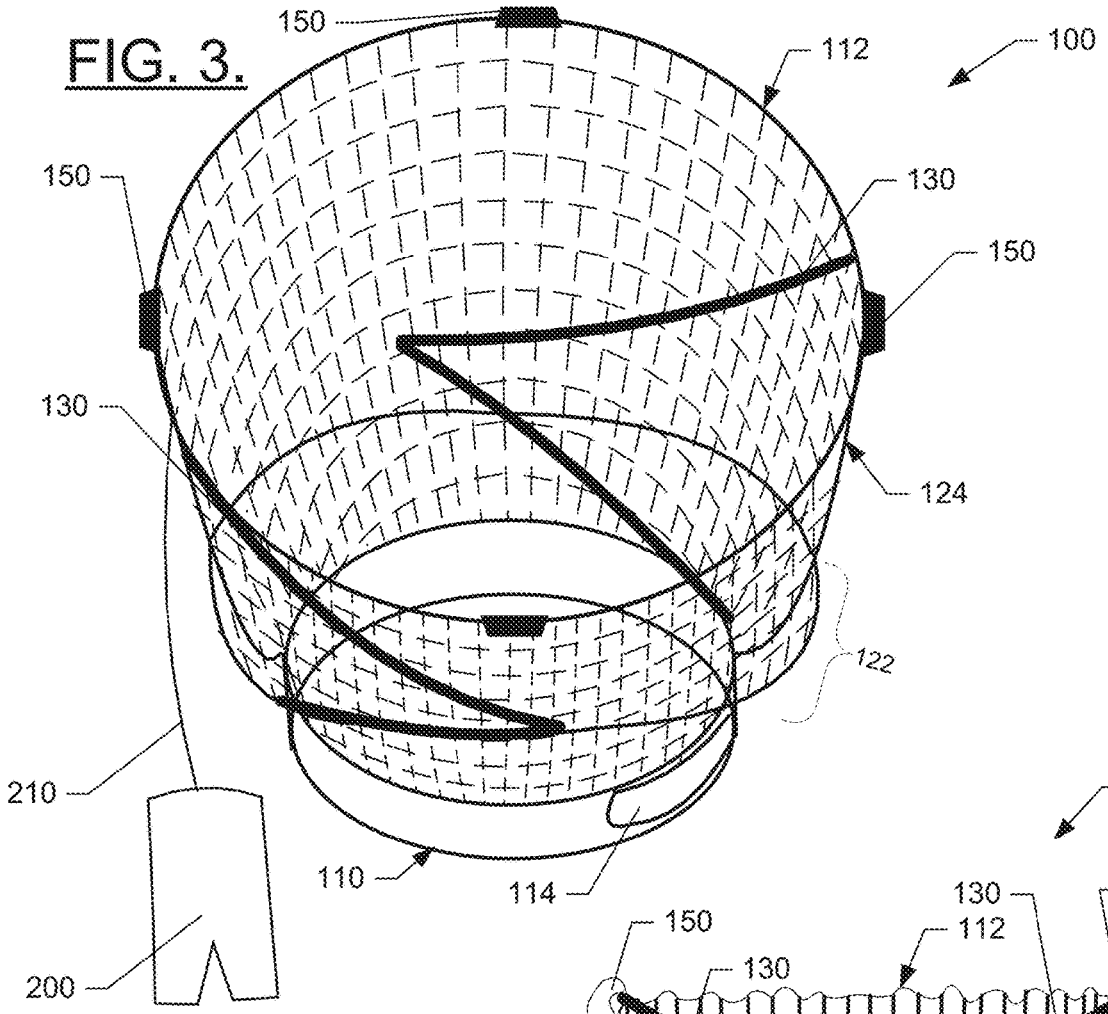
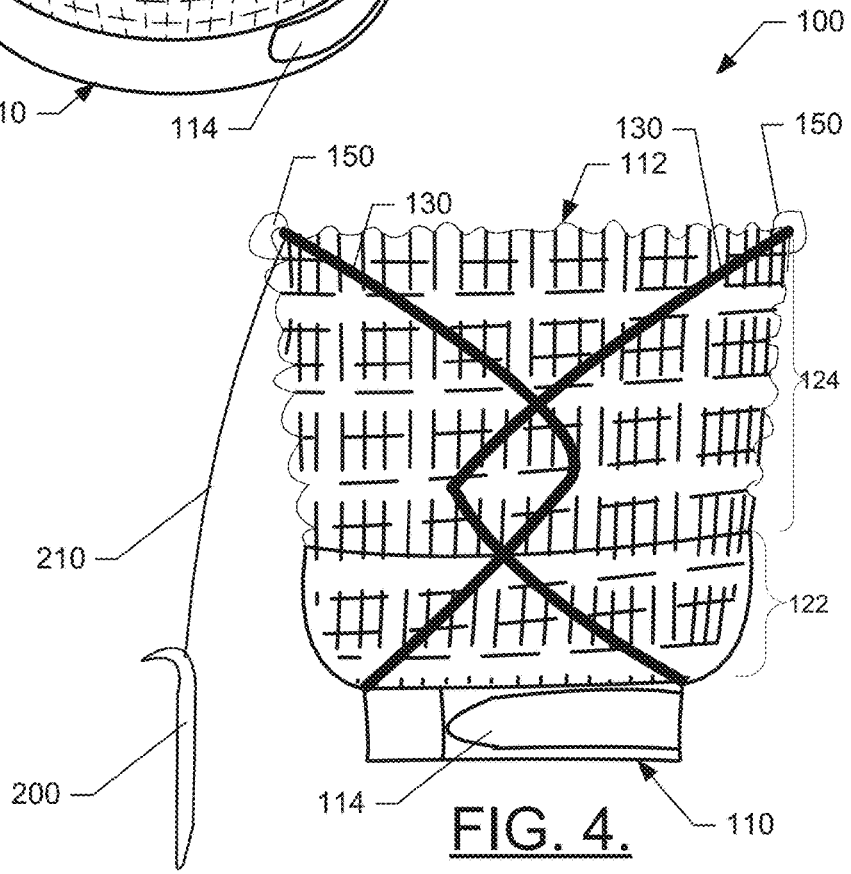
FIG. 4.

POWER TOOL ACCESSORY FOR PREVENTING FASTENER FALLS DURING FASTENER REMOVAL OR INSTALLATION OPERATIONS

TECHNICAL FIELD

Example embodiments generally relate to an accessory that can be used with a power tool and, more particularly, relate to an accessory that is attachable to the power tool for preventing the falling of fasteners that are being removed (or installed) during operation of the power tool.

BACKGROUND

Handheld power tools such as drills, bit drivers, nut drivers, socket drivers, nut runners, and/or other fastening tools, are often used to perform tasks relating to the application or removal of fasteners. In several industrial and residential contexts, the fastening tools may be used in a situation that places the operator of the fastening tool underneath the fastening tool and the fastener that is being applied or removed. In these situations, if the fastener should happen to fall, the fastener essentially becomes foreign object debris (FOD) that can potentially injure the operator or damage other equipment. Moreover, the fastener may become lost or damaged, thereby potentially increasing cost.

One way the problem of dealing with the potential for falling fasteners has been handled in the past has been for the operator to hold one hand near the fastener to be ready to catch the fastener if it falls. Not only is this method difficult to employ, but it is also a relatively unreliable method. However, even if the operator catches a falling fastener, the luck or skill associated with success then necessitates further operator activity as the fastener must be repositioned or separately placed in a container (e.g., a bag) while the operation is attempted again with the same or a different fastener. Accordingly, this particular method leads to the operator repeating unnecessary movements or reaching, bending or otherwise taking an unusual and/or tension inducing position and can generate and/or accelerate substantial muscle fatigue.

Accordingly, it may be desirable to provide a solution to the potential problem of falling fasteners that is both easy to use and effective both from a practicality standpoint and from a cost perspective.

BRIEF SUMMARY OF SOME EXAMPLES

Some example embodiments may therefore provide an accessory that can be used in a variety of contexts to mitigate or even eliminate the risk of falling fasteners associated with the operation of power tools.

In one example embodiment, an accessory for catching a fastener responsive to operation of a power tool having a working assembly for driving or removing the fastener is provided. The accessory may include a working end, a coupling end opposite the working end, and a catch portion disposed between the working end and the coupling end. The coupling end may be configured to be operably coupled to the power tool to be fixed rotationally and axially relative to an axis of the working assembly. The catch portion may extend substantially coaxial with the axis of the working assembly away from the coupling end to the working end. The working end may be configured to extend beyond a distal end of the working assembly.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 3 illustrates a top perspective view of the accessory with a removal hook tethered thereto in accordance with an example embodiment; and FIG. 4 illustrates a side view of the accessory with the removal hook tethered thereto in accordance with an example embodiment.

DETAILED DESCRIPTION

Figure 1:
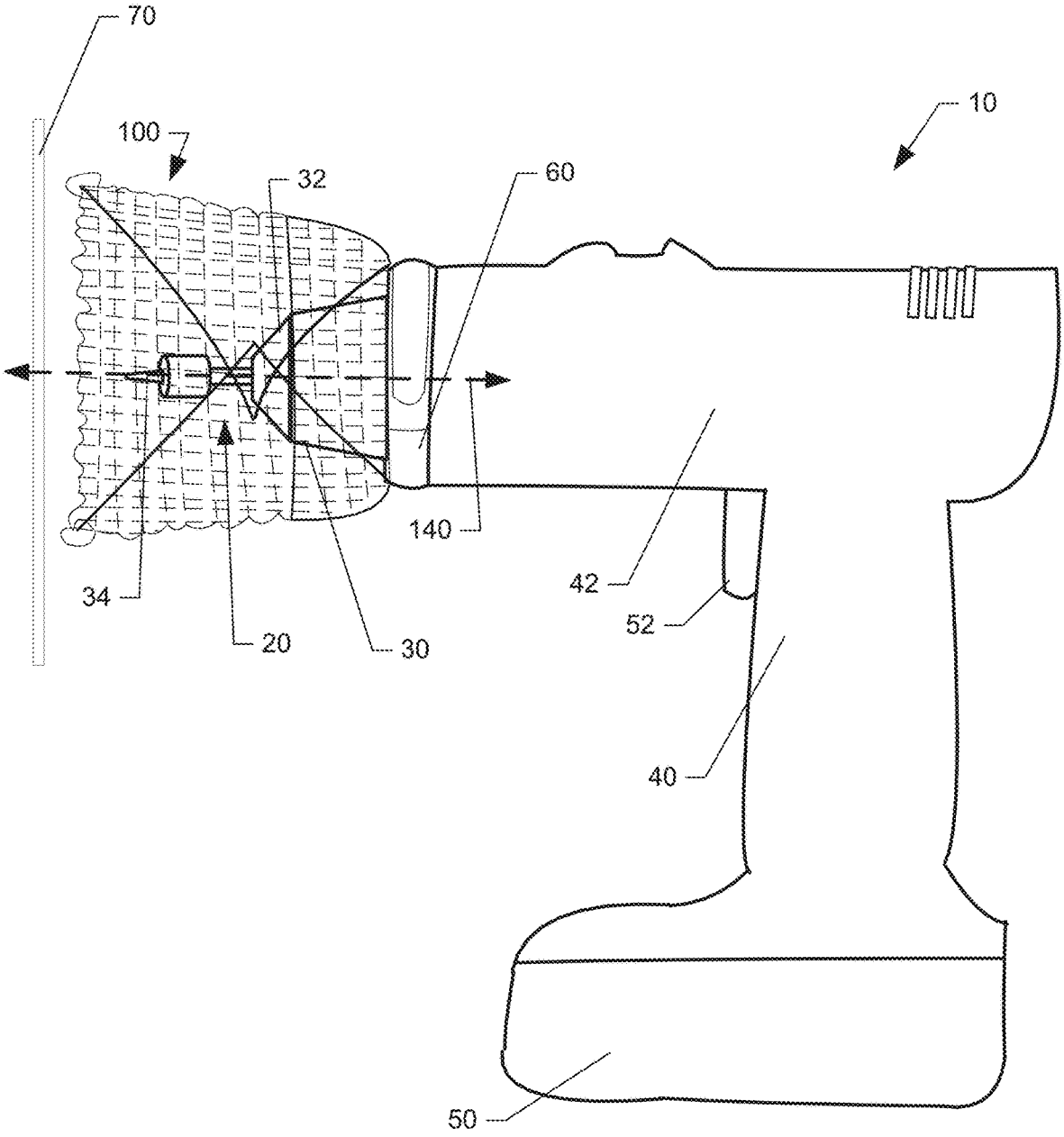
FIG. 1 illustrates a perspective view of a power tool that may employ an accessory in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. One of skill in the art will appreciate that the normal position in which devices of example embodiments are held for operation of the working assembly represents the front of such devices. All other directional references should be understood in this general context.

Some example embodiments described herein provide an accessory (e.g., a "fall fast" accessory) that can be easily attached to surround the working assembly of a power tool (such as a fastening tool). In particular, some example embodiments provide an accessory that can be attached to a number of different models or sizes of fastening tools in order to catch fasteners that may otherwise fall during fastener application or removal. The solution may save time, money, and may also improve operator safety while also having a positive impact on the capability of operators to continue to perform fastening operations without fatigue.

Referring to the drawings, FIG. 1 illustrates a perspective view of a power tool 10 that may employ an accessory 20 in accordance with an example embodiment. However, it should be appreciated that the power tool 10 (e.g., a battery powered, hand-held drill) is merely one example of a fastening tool device that may be configured in accordance with an example embodiment. Thus, example embodiments could alternatively be employed in connection with corded versions of various electric powered, fastening tools or even with tools that are gas powered, pneumatic, or powered in any other suitable way. Thus, although an example embodiment will be described hereinafter with specific reference to the power tool 10 of FIG. 1, the applicability of alternative embodiments relative to other types of fastening tools should be well understood. Additionally, the specific functions and structures of the power tool 10 shown in FIG. 1 could be altered in other examples without departing from the scope of example embodiments.

As shown in FIG. 1, the power tool 10 may include a working implement or working assembly 20, which in this example includes a socket driving assembly. The working assembly 20 may further include a chuck 30 that operates jaws 32 that are configured to securely hold a drill bit, socket driver, nut driver, screw driver head (e.g., Phillips head, slotted, Robertson head, etc.) that mates with a fastener 34 to enable the fastener 34 to be applied to or removed from one or more surfaces or components.

The power tool 10 may include a handle 40 that extends away from a motor housing 42 inside which a motor for driving the working assembly 20 is housed. The motor housing 42 may take a number of different shapes. In this example, the motor housing 42 may be substantially cylindrical in shape. However, rectangular, oblong or oval cross sectional shapes that either taper or do not taper are also common. Although the handle 40 is shown to extend away from the motor housing 42 at a right angle in this example, it should be appreciated that the handle 40 could be in-line with the motor housing 42 or at a different angle relative to the motor housing in other examples.

In this example, the motor housing 42 may house an electric motor that is powered by a battery 50. However, as mentioned above, other power sources are possible in alternative embodiments. The motor may turn the working assembly 20 responsive to actuation of an actuator (e.g., trigger 52). Actuation of the trigger 52 may couple electrical power from the battery 50 to the motor to cause operation (i.e., turning) of the working assembly 20. In some cases, the working assembly 20 may be operable in either a driving or removing direction (e.g., clockwise or counterclockwise, respectively). As such, the power tool 10 may include a selector that can be used to alter the direction of turning of the motor and consequently also the working assembly 20.

In some cases, the power tool 10 may further include a collar 60 that may be used to make torque selections, operate a clutch, or otherwise impact operation of the working assembly 29. When employed, the collar 60 generally has an annular shape regardless of the shape of the motor housing 42. Moreover, the chuck 30 also generally has an annular external periphery, again regardless of the shape of the motor housing 42.

As shown in FIG. 1, an accessory 100 may be operably coupled to the power tool 10 to substantially surround the working assembly 20 of the power tool 10 except that a working end of the accessory 100 is left open even after the accessory 100 is operably coupled to the power tool 10 in order to enable the working assembly 20 to access the fastener 34 when the fastener 34 is being applied to or removed from a surface 70. Of note, the surface 70 of FIG. 1 appears to be vertically oriented. The accessory 100 performs its function well in this context, of course. However, the accessory 100 also performs its function (i.e., containment of the fastener 34 in case the fastener 34 should fall out of the surface or out of contact with the working assembly 20) regardless of the orientation of the surface 70. Thus, for example, the accessory 100 also functions in contexts in which the surface is horizontal (with the power tool 10 operating above or below the surface 70) or at any angles between horizontal and vertical orientations.

The accessory 100 may generally take the form of a cup that is open at both ends. The opening at one end is used to operably coupled the accessory 100 to the power tool 10, while the opening at the other end is used to enable the working assembly 20 to access the fastener 34 and the fastener 34, while engaged with the working assembly 20, to access the surface 70. As such, the accessory 100 may sometimes take the shape of a hollow cylinder that may taper as the end that operably couples to the power tool 10 is approached. However, other shapes are also possible.

Figure 2:
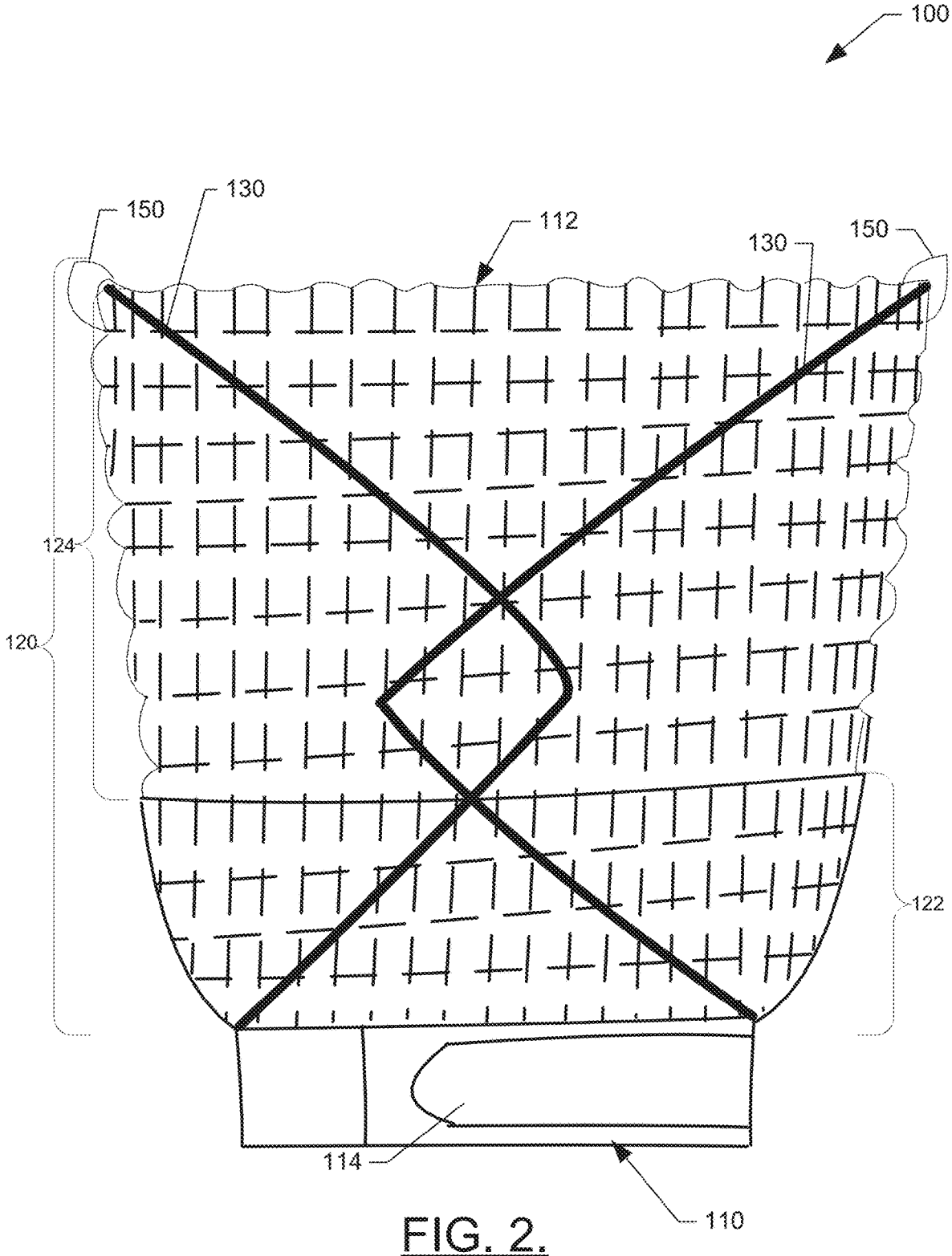
FIG. 2 illustrates a close in, side view of the accessory in accordance with an example embodiment.

Referring now to FIGS. 2-4, some structural details of the accessory 100 of an example embodiment will be described in greater detail. In this regard, the accessory 100 may include a coupling end 110 and a working end 112. The coupling end 110 may be the portion of the accessory 100 that operably couples to (or mates with) the power tool 10. Meanwhile, the working end 112 may be (and remain) open to enable the working assembly 20 of the power tool 10 to engage the fastener 34, and to engage the fastener 34 to engage the surface 70, as described above. Between the working end 112 and the coupling end 110, the accessory 100 may include a catch portion 120. In an example embodiment, a majority (and in some cases all) of the catch portion 120 may be clear, transparent or otherwise see through to enable the operator to have a relatively unobstructed view of the working assembly 20, the fastener 34 (if possible), and/or the surface 70 during operation of the power tool 10.

The coupling end 110 may include an adjustable strap 114 or other such coupling mechanism that is configurable to mate with the collar 60 or the motor housing 42 of the power tool 10. The coupling end 110 may be defined by a portion of material that can be extendible in diameter to extend around the collar 60 or motor housing 42, and the material may (e.g., at least on an internal surface thereof—i.e., a surface facing the collar 60 or the motor housing 42) be configured to be non-slip relative to plastic or metal surfaces that may typically be used to form the collar 60 or the motor housing 42. The non-slip material may ensure that the accessory 100 stays in place while the working assembly 20 turns and while the power tool 10 may vibrate. As such, the non-slip material may also ensure that the accessory 100 does not slip along a surface of either the collar 60 or the motor housing 42 to fix the accessory 100 axially and radially. In an example embodiment, the adjustable strap 114 may include a hook and loop fastener, an adjustable strap buckle, and/or the like in order to enable the coupling end 110 to be adjusted in size and/or shape to mate with a variety of models and types of power tool 10. When the adjustable strap 114 is used to operably couple the coupling end 110 to the power tool 10, the coupling end 110 is effectively closed.

The length and width dimensions of the accessory 100 may be fixed in some cases, since the adjustable strap 114 enables the same accessory 100 to fit a number of different power tools. In this regard, although the working end 112 may have a fixed diameter, the coupling end 110 may effectively have a variable and selectable diameter to fit different collars and/or motor housings. However, in some cases, commercial power tools may have smaller sizes by nearly an order of magnitude relative to some industrial power tools. Thus, entirely different sizes of the accessory 100 could be produced in some cases. Although any size is theoretically possible, a typical instance of the accessory 100 may have a length in a range of between 3 inches to 6 inches, and a width of the accessory 100 may range also from about 3 inches to about 6 inches. However, in an example embodiment, the length of the accessory 100 may be chosen to ensure that the working end 112 extends beyond a distal end of the working assembly 20 of the power tool 10. In some cases, the length may further be selected in consideration of the length of the fastener 34 so that the combined length of the working assembly 20 and the fastener 34 is less than the length of the accessory 100. The diameter of the accessory 100 may also taper toward the coupling end 110 in order to "funnel" or guide the fastener 34 and define a wide catch radius for the fastener 34 if the fastener 34 should fall.

In an example embodiment, the catch portion 120 may be defined by a reinforced portion 122 and a flexible portion 124. The reinforced portion 122 may be disposed proximate to the coupling end 122, and may extend less than half the longitudinal length of the accessory 100 away from the coupling end 122. The flexible portion 124 may be disposed proximate to the working end 112, and may extend greater than half the longitudinal length of the accessory 100 away from the working end 112. In some cases, the reinforced portion 122 may be embodied as a unitary piece of plastic, rubber, fiberglass or other substantially rigid material that gives the reinforced portion 122 a desired shape, and also enables secure catching of the fastener 34 in case the fastener 34 falls during or responsive to operation of the power tool 10 when the surface 70 is horizontal (or at least when the working end 112 is oriented upward to some degree). The reinforced portion 122 may effectively operate as a bowl or cup with an open bottom that is filled by the power tool 10 when the accessory 100 is mated to the power tool 10. In this regard, for example, the reinforced portion 122 may define a transition from the flexible portion 124 to the adjustable strap 114. The adjustable strap 114 may extend away from the reinforced portion 122 at an angle that is substantially parallel to a longitudinal axis of the accessory 100. Meanwhile, the reinforced portion 122 may initially extend away from the longitudinal axis of the accessory 100 and then transition to the flexible portion 124 which may be substantially cylindrical or slightly conical in shape. The working assembly 20 and at least a portion (if not all) of the chuck 30 may pass through the open bottom of the reinforced portion 122 and into a center of the accessory 100 that may be surrounded by the flexible portion 122 to, with the adjustable strap 114, form a surface against which the fastener 34 may be caught or otherwise retained between the reinforced portion 122 and the chuck 30.

The provision of the reinforced portion 122 may enhance the operation of the accessory 100 in a number of ways. First, the rigid nature of the reinforced portion 122 may provide audible feedback to the operator when the fastener 34 hits and is retained in the accessory 100 to indicate that a fall of the fastener 34 has occurred, and that the fastener 34 has been caught. If the reinforced portion 122 is transparent or otherwise see through, the reinforced portion 122 may also enable the fastener 34 to be visible to the operator to facilitate retrieval of the fastener 34. The reinforced nature of the reinforced portion 122 may also allow multiple fasteners to be retained, if desired, so that the operator need not necessarily separately retrieve each and every fastener that has fallen and been retained therein. Whether retaining one or multiple fasteners, if the weight of the fastener(s) retained is substantial, the reinforced portion 122 may prevent a collapse of the accessory 100 due to weight or pressure constraints. The reinforced portion 122 also gives a consistent shape to the coupling end 110 of the accessory 100 and, when provided as a unitary piece, actually catch some fluid, dust or other debris therein to further protect the eyes, skin, mouth or even the cloths of the operator in some cases.

The flexible portion 124 may be formed from a flexible material that is also substantially clear, transparent or see through. In some cases, the flexible portion 124 may be embodied as a web, net, mesh or other lattice of material made from a plurality of threads that are interwoven together in a way that creates a structure of sufficient size (i.e., having thread spacing narrow enough) to catch fasteners 34 while also maintaining good visibility for the operator inside the accessory 100. In some cases, the flexible portion 124 may be a substantially clear or transparent cloth or other material (e.g., plastic) that is durable, see through, and flexible.

In an example embodiment, a support assembly 130 may extend at least between the reinforced portion 122 and the working end 112 of the flexible portion 124 of the accessory 100. Moreover, in some cases, the support assembly 130 may extend all the way from the working end 112 to the coupling end 110. The support assembly 130 may be embodied as one or more tension wires or other similar substantially rigid, but bendable members that can provide support to the flexible portion 124 to form the cylindrical (or slightly conical to frustoconical) shape of the accessory 100 at the flexible portion 124. In some cases, one or more tension wires may also form an annulus at the working end 112 and/or the coupling end 110 to facilitate forming the shape of the accessory 110. The support assembly 130 (e.g., tension wires, if included) may generally have an untensioned state that defines the normal shape of the flexible portion 124, but may be moveable to a tensioned state that enables the working assembly 20 to reach the surface 70 so the fastener 34 can be engaged. Moreover, in the tensioned state, the support assembly 130 may further enable the working end 112 to conform to the surface 70 in case the surface is at an angle relative to the working assembly 20, or in case the surface 70 is irregular in shape.

When the support assembly 130 is in the tensioned state and released to the untensioned state, the accessory 100 may return to its normal shape (e.g., the shape shown in FIGS. 3 and 4). As such, the tension wires shown in the depicted example may, for example, include a bent portion that effectively creates a spring-like capability for the tension wires to transition between the tensioned and untensioned state responsive to compression of the tension wires about the bent portion and subsequent release of the compression.

The catch portion 120 may extend substantially coaxial with an axis 140 of the working assembly 20 from the coupling end 110 to at least beyond the distal end of the working assembly 20. As such, the catch portion 120 may define a catch radius around the distal end of the working assembly 20. Moreover, the support assembly 130 may facilitate holding the general shape of the catch portion 120 in the untensioned state so that the catch portion 120 remains substantially coaxial with the axis 140 of the working assembly 20 until the shape of the catch portion 120 is altered (e.g., by contact with the surface 70).

In an example embodiment, the working end 112 of the accessory 100 may be covered (entirely or partially) by a padding material 150. The padding material 150 may be mark resistant and, in some cases, may be compressible to avoid scratching or marring of the surface 70. In the example of FIGS. 2-4, the padding material 150 is provided on the annulus at the working end 112 at discrete intervals spaced apart from each other. However, in other examples, the entire annulus may be covered in the padding material 150. In some cases, the padding material 150 may be fabric, soft rubber, or any other suitable material.

In some cases, regardless of the orientation of the surface 70, the fastener 34 may be loosened from, for example, a screw hole formed in the surface 70, but may not fall or even be easily removable from the surface 70 by hand. In such cases, it may be helpful to include a removal hook 200 that can be tethered to the accessory 100. In the examples of FIGS. 3 and 4, the removal hook 200 may be attached to the annulus at the working end 112 by a tether 210. However, the tether 210 could alternatively be attached to any other suitable portion of the accessory 100.

The removal hook 200 may, for example, include forked members that may be slid between the surface 70 and a head portion of the fastener 34 to enable the fastener 34 to be pried, lifted or otherwise removed from the surface 70. In this regard, the removal hook 200 may be used similar to a crow bar, or the nail removal end (e.g., the claw) of a hammer. In some cases, the operator may hold the accessory 100 below the fastener 34 to catch the fastener 34 while the operator pries or otherwise uses the removal hook 200 to remove the fastener 34 from the surface 70.

In accordance with an example embodiment, an accessory for catching a fastener responsive to operation of a power tool having a working assembly for driving or removing the fastener is provided. The accessory may include a working end, a coupling end opposite the working end, and a catch portion disposed between the working end and the coupling end. The coupling end may be configured to be operably coupled to the power tool to be fixed rotationally and axially relative to an axis of the working assembly. The catch portion may extend substantially coaxial with the axis of the working assembly away from the coupling end to the working end. The working end may be configured to extend beyond a distal end of the working assembly.

In some embodiments, the features or operations of the accessory described above may be augmented or modified, or additional features or operations may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the coupling end may include an adjustable strap configured to engage a collar or motor housing of the power tool. In some cases, the coupling end may include material that is extendible in diameter to extend around the collar or the motor housing, and be affixed to the collar or motor housing via the adjustable strap. In an example embodiment, the adjustable strap may include a hook and loop fastener. In some embodiments, a portion of the adjustable strap that faces the collar or motor housing may include a non-slip material. In some cases, the catch portion may include a reinforced portion and a flexible portion. The reinforced portion may be disposed proximate to the coupling end, and the flexible portion may extend at least from the reinforced portion to the working end. In an example embodiment, the reinforced portion may include a rigid material that is clear, transparent or see through. In some embodiments, the flexible portion may include a flexible material that is clear, transparent or see through. In some cases, the flexible portion includes a net, mesh or lattice material. In an example embodiment, the flexible portion overlaps the reinforced portion over an entirety of the reinforced portion. In some embodiments, the flexible portion may be supported by a support assembly that extends at least from the reinforced portion to the working end. In some cases, the support assembly includes one or more tension wires configured to support the flexible portion such that the working end extends beyond the distal end of the working assembly in an untensioned state, and configured to enable the flexible portion to be altered in shape as the working end conforms to a surface that the fastener is being applied to or removed from in a tensioned state. In an example embodiment, the accessory may further include padding material disposed at the working end to contact a surface that the fastener is being applied to or removed from. In some cases, the padding material may be disposed in discrete intervals over the working end. In some embodiments, a removal hook may be tethered to the catch portion. In an example embodiment, the removal hook may be tethered to the support assembly. In some cases, the reinforced portion may extend from the coupling end less than half a length of the catch portion along the axis of the working assembly. In some embodiments, the flexible portion may extend from the working end more than half the length of the catch portion along the axis of the working assembly. In an example embodiment, a width of the catch portion increases as distance from the coupling end increases. In some cases, a diameter of the coupling end may be adjustable, and a diameter of the working end may be fixed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An accessory for catching a fastener responsive to operation of a power tool having a working assembly for driving or removing the fastener, the accessory comprising:

a working end;

a coupling end opposite the working end; and a catch portion disposed between the working end and the coupling end, wherein the coupling end is configured to be operably coupled to the power tool to be fixed rotationally and axially relative to an axis of the working assembly, wherein the catch portion extends substantially coaxial with the axis of the working assembly away from the coupling end to the working end, and wherein the working end is configured to extend beyond a distal end of the working assembly, wherein the catch portion comprises a reinforced portion and a flexible portion, and wherein the reinforced portion is disposed proximate to the coupling end, and the flexible portion extends at least from the reinforced portion to the working end, wherein the flexible portion comprises a flexible material that is clear, transparent or see through, and wherein the flexible portion comprises a net, mesh or lattice material.

2. The accessory of claim 1, wherein the coupling end comprises an adjustable strap configured to engage a collar or motor housing of the power tool.

3. The accessory of claim 2, wherein the coupling end comprises material that is extendible in diameter to extend around the collar or the motor housing, and be affixed to the collar or motor housing via the adjustable strap.

4. The accessory of claim 3, wherein the adjustable strap comprises a hook and loop fastener.

5. The accessory of claim 3, wherein a portion of the adjustable strap that faces the collar or motor housing comprises a non-slip material.

6. The accessory of claim 1, wherein the flexible portion overlaps the reinforced portion over an entirety of the reinforced portion.

7. The accessory of claim 1, wherein the reinforced portion comprises a rigid material that is clear, transparent or see through.

8. The accessory of claim 1, wherein the flexible portion is supported by a support assembly that extends at least from the reinforced portion to the working end.

9. The accessory of claim 8, wherein the support assembly comprises one or more tension wires configured to support the flexible portion such that the working end extends beyond the distal end of the working assembly in an untensioned state, and configured to enable the flexible portion to be altered in shape as the working end conforms to a surface that the fastener is being applied to or removed from in a tensioned state.

10. The accessory of claim 8, further comprising padding material disposed at the working end to contact a surface that the fastener is being applied to or removed from.

11. The accessory of claim 10, wherein the padding material is disposed in discrete intervals over the working end.

12. The accessory of claim 8, wherein a removal hook is tethered to the catch portion.

13. The accessory of claim 12, wherein the removal hook is tethered to the support assembly.

14. The accessory of claim 1, wherein the reinforced portion extends from the coupling end less than half a length of the catch portion along the axis of the working assembly.

15. The accessory of claim 14, wherein the flexible portion extends from the working end more than half the length of the catch portion along the axis of the working assembly.

16. The accessory of claim 1, wherein a width of the catch portion increases as distance from the coupling end increases.

17. The accessory of claim 1, wherein a diameter of the coupling end is adjustable, and a diameter of the working end is fixed.

* * * * *